US011377265B1

(12) United States Patent
Litts

(10) Patent No.: US 11,377,265 B1
(45) Date of Patent: Jul. 5, 2022

(54) BAG CLOSING SEAL

(71) Applicant: Lisa M. Litts, Hyde Park, NY (US)

(72) Inventor: Lisa M. Litts, Hyde Park, NY (US)

( * ) Notice: Subject to any disclaimer, the term of this patent is extended or adjusted under 35 U.S.C. 154(b) by 0 days.

(21) Appl. No.: 16/128,804

(22) Filed: Sep. 12, 2018

(51) Int. Cl.
*B65D 33/18* (2006.01)
*B65D 75/58* (2006.01)
*B65D 33/25* (2006.01)

(52) U.S. Cl.
CPC ..... *B65D 33/18* (2013.01); *B65D 33/25* (2013.01); *B65D 75/5855* (2013.01)

(58) Field of Classification Search
CPC ..... B65D 33/18; B65D 33/25; B65D 75/5855
USPC ..... 383/211
See application file for complete search history.

(56) References Cited

U.S. PATENT DOCUMENTS 3,203,621 A * 8/1965 Wright ..... B65D 33/1691 383/81
3,958,749 A * 5/1976 Goodrich ..... B65D 31/02 383/206
4,502,599 A 3/1985 Perecman
4,584,201 A 4/1986 Boston
4,637,063 A * 1/1987 Sullivan ..... B65D 33/25 383/111
4,785,940 A 11/1988 Wilson
4,905,298 A * 2/1990 Walor ..... B65D 33/16 383/61.2
5,007,744 A 4/1991 Scarberry et al.
5,211,482 A * 5/1993 Tilman ..... B65D 33/2591 24/DIG. 50
5,330,269 A * 7/1994 Kamada ..... B65D 33/2525 383/210
5,492,411 A * 2/1996 May ..... B65D 33/2525 383/210
5,575,747 A 11/1996 Dais
5,749,658 A * 5/1998 Kettner ..... B29D 5/10 383/204
5,827,163 A * 10/1998 Kettner ..... B29D 5/10 493/211
6,088,887 A * 7/2000 Bois ..... B65D 33/2508 24/399
6,131,248 A * 10/2000 Tomic ..... B65D 33/2533 220/359.3
6,238,090 B1 * 5/2001 Yuter ..... B65D 21/08 383/2
6,290,393 B1 * 9/2001 Tomic ..... B65D 33/2591 24/399
6,290,998 B1 * 9/2001 Layton ..... B65D 33/004 383/70
6,386,760 B1 * 5/2002 Tomic ..... B65D 33/2591 383/203
6,440,051 B1 * 8/2002 Lauzon ..... B31B 70/00 383/204
6,461,044 B1 10/2002 Anderso
6,499,878 B1 * 12/2002 Dobreski ..... B65D 33/2508 383/5
6,789,374 B1 9/2004 Bois
(Continued)

*Primary Examiner* — Peter N Helvey
(74) *Attorney, Agent, or Firm* — Lawrence D. Cutter, Esq.

(57) ABSTRACT

A bag sealing device comprises an opposed press lock structure together with two adhesive bearing strips disposed below the press lock structure together with at least one strip that is employed to prevent premature sticking of the two adhesive bearing strips. This device is employed in combination with a bag containing a food product with disposed within the bag.

3 Claims, 5 Drawing Sheets

(56) References Cited

U.S. PATENT DOCUMENTS 7,160,029 B2 * 1/2007 Bein ..... B65D 5/643 206/494
7,213,305 B2 * 5/2007 Stolmeier ..... B65B 9/20 24/389
7,581,371 B2 * 9/2009 Owensby ..... B65D 51/185 206/466
7,866,011 B2 * 1/2011 Greco ..... B65D 33/2508 24/399
7,926,702 B2 * 4/2011 Childs ..... A45C 11/00 229/87.19
7,937,908 B2 * 5/2011 Anzini ..... B65B 61/188 53/412
7,963,007 B2 * 6/2011 Anzini ..... B65D 33/2584 24/30.5 R
8,087,828 B2 * 1/2012 Noguchi ..... B65D 33/2508 383/210.1
8,517,609 B2 * 8/2013 Conner ..... B65D 33/00 229/101
8,794,834 B2 * 8/2014 Forman ..... B65D 33/1691 383/2
10,633,148 B2 * 4/2020 Chaturvedi ..... B65D 33/2525
10,730,674 B2 * 8/2020 Wintz ..... B65D 63/12
2001/0022867 A1 9/2001 Yeager
2001/0053253 A1 * 12/2001 Buchman ..... B65D 33/2591 383/5
2002/0114541 A1 8/2002 Huffer et al.
2005/0194386 A1 * 9/2005 Shai ..... B65D 77/003 150/154
2006/0062495 A1 * 3/2006 Plourde ..... B65D 33/2591 383/61.2
2008/0050056 A1 * 2/2008 Anzini ..... B65D 33/2591 383/210.1
2009/0190862 A1 * 7/2009 Barksdale ..... B65D 33/1691 383/64
2009/0274399 A1 11/2009 Jenkins et al.
2013/0089275 A1 * 4/2013 Montoya ..... B65D 33/2508 383/42
2014/0307986 A1 * 10/2014 Hudspeth ..... B65D 33/1691 383/95
2015/0266626 A1 9/2015 Forman et al.
2016/0046423 A1 * 2/2016 Rabban ..... B65D 33/2508 383/210
2020/0071032 A1 3/2020 Trinh
2020/0346822 A1 * 11/2020 Hall ..... B65B 51/065

* cited by examiner

BAG CLOSING SEAL

TECHNICAL FIELD

The present invention is generally directed to the sealing of opened bags of food products. More particularly, the present invention is directed to a system and method for reclosing a bag that has been opened so that a more air tight seal is provided. Even more particularly, the present invention is directed to a combination of a bag containing a product intended to be kept fresh together with an enclosed device for freshness preservation following the opening of the bag.

BACKGROUND OF THE INVENTION

After opening a bag containing a food product, it becomes problematic to reclose the bag again in a manner which maximally preserves prescience. For purposes of the present discussion, the focus is on a bag of potato chips which serves as an exemplar for the present invention. However, any bag containing a food product which loses its desirability upon exposure to air is intended to be covered by the present discussion. This includes items such as pretzels, cookies, chips, baked goods, popcorn, nuts, fruit products especially dried fruits and the like.

As alluded to above, it is observed that various food products lose their freshness when exposed to air, most notably because of the presence of oxygen in air. If the food product is consumed immediately this issue becomes moot. However, it is often the case that the food product is consumed over a period of time rather than just at a single sitting. Reclosing the bag that the food product came in then becomes an issue. This is the issue that is addressed by the present invention.

There are several types of closures which are effective in keeping air out of the package for a sufficiently desirable period of time. The most notable form of this closure is the well-known Ziploc® bag. These bags generally come in two different varieties. In the first variety, an airtight seal is maintained by pressing together two opposite facing flexible strips with one strip bearing a raised, rounded ridge which is pressed into a corresponding ridge on the opposite strip which includes a depressed portion into which the raised ridge is inserted. A second variety of airtight seals is similar to the first variety except that the ceiling operation is performed via the motion of a sliding piece which acts to press the raised ridge into a corresponding depression on the other strip. The present invention is capable of using either one of these well-known sealing mechanisms to achieve the desired airtight seal. More generally, sealing mechanisms of the kind referred to above are generally referred to as press lock seals. Accordingly, the sealing mechanisms employed in conjunction with the present invention are referred to herein generically as "press lock seals."

However, as is well known, the great majority of food products sold in bag like containers do not include any mechanism for resealing. Instead, this function is often carried out by means of rolling the top of the bag over and over so as to produce a closure. This closure may be maintained by means of an elastic band, a paper clamp or a paperclip. Sometimes, this closure is even maintained by means of one or more strips of adhesive tape. This is the typical approach to providing a resealing once a food product bag has been opened. It is, of course, assumed herein that the food product bag is otherwise airtight.

The problem is that this mechanism for post-opening re-closure does not really keep air out of the container. Air still seeps in and operates to reduce the freshness of the food product. As tightly as one might roll the top of the bag downward in an overlapping fashion this mechanism does not provide a sufficiently tight seal which is capable of preserving food freshness over relatively arbitrary lengths of time.

Efforts at providing solutions to the sealing issue described above include the issued U.S. Pat. No. 4,584,201 issued to L. R. Boston on Apr. 22, 1986. However, it is noted that his device requires rolling up of the bag, and operation that is not required by the present invention and which furthermore fails to provide the desired degree of air tightness. Another approach this problem has been proposed by Huffer et al. is US patent application number 2002/0114541 published on Aug. 22, 2002. This application is directed to resealing bags but requires that the sealing mechanism be already built into the bag. There is no retrofit capability. A different approach for a related problem (package tampering) is shown in US patent application number 2015/0266626 published on Sep. 24, 2015 in the name of Forman et al. The technique described therein requires the use of transparent tape and a slit in the bag neither of which are employed in the present invention.

From the above, it is therefore seen that there exists a need in the art to overcome the deficiencies and limitations described herein and above.

SUMMARY OF THE INVENTION

It should be appreciated that this Summary is provided to introduce a selection of concepts in a simplified form that are further described below in the Detailed Description. This Summary is not intended to be used to limit the scope of the claimed subject matter.

The shortcomings of the prior art are overcome and additional advantages are provided through a simple device for sealing an opened bag. In particular, the device comprises: a length of press lock seal with opposing strip portions disposed below the press lock seal; and adhesive material disposed on opposed inside portions of the opposing strip portions; and at least one removable adhesive covering strip disposed between the oppositely facing adhesive material.

In a preferred embodiment of the present invention each of the strips containing adhesive material is provided with an adhesive covering strip which is removable by means of a simple peeling operation. This covering strip is intended to prevent premature application of the adhesive to the bag in question and it is also intended to prevent the two strips from sticking to one another before the intended use of the present invention.

While it is possible to employ a single covering strip for the prevention of the premature engaging of the adhesive, it is preferable that a single covering strip be employed for each adhesive area.

In another aspect of the present invention, it is disposed within a food product bag at the time of sale. After sale and opening of the food product bag, it can be removed from the bag and employed to effectuate the sealing operation disclosed herein. Accordingly, it is an object of the present invention to keep food fresher longer.

It is another object of the present invention to provide a mechanism for the re-closure of an open the food product bag.

It is yet another object of the present invention to provide a conveniently packaged combination of a food product bag together with an instance of the present invention to be used as a bag closure subsequent to its opening by the food product consumer.

It is a still further object of the present invention to provide an easily manufactured device for food product bag closure.

It is still another object of the present invention to encourage the use of a bag closure device for the preservation of food freshness.

Lastly, but not limited hereto, it is an even further object of the present invention to make the resealing of food product bags simple, inexpensive and easy.

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

Figure 1:
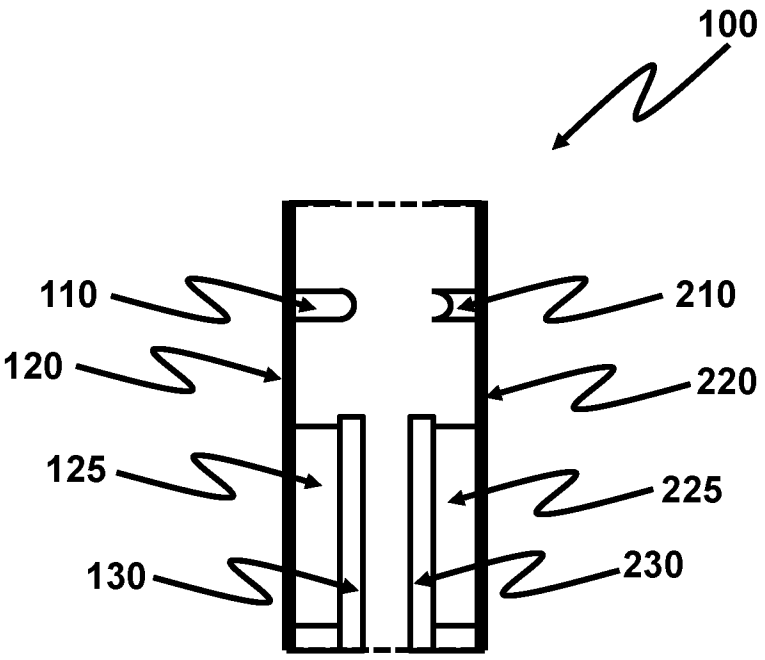
FIG. 1 is a cross-sectional end view illustrating one embodiment of the present invention.

FIG. 1 illustrates the present invention from an edge on or cross-sectional view. Press lock portions 110 and 210 are designed to form a tight seal when pressed together in a locked fashion. These portions can have any convenient size or shape as long as they fit together snugly when pressed together so as to form a substantially airtight seal. While there is only one such structure shown, it is possible to employ double or triple structures for better sealing purposes. These press lock portions are supported by flexible substrate 120 on one side and 220 on the opposite side. The structures preferably comprises a material such as a flexible polymer and more particularly a polymer such as polyethylene. However, any convenient substrate will work, its primary requirement being that it is flexible. Substrates 120 and 220 include strips of adhesive 125 and 225 disposed on their respective interior surfaces. There is also provided peelable protective cover strips 130 and 230 respectively over adhesive portions 125 and 225. The dotted line indicates that flexible substrates 120 and 220 are joined at their ends.

Figure 2:
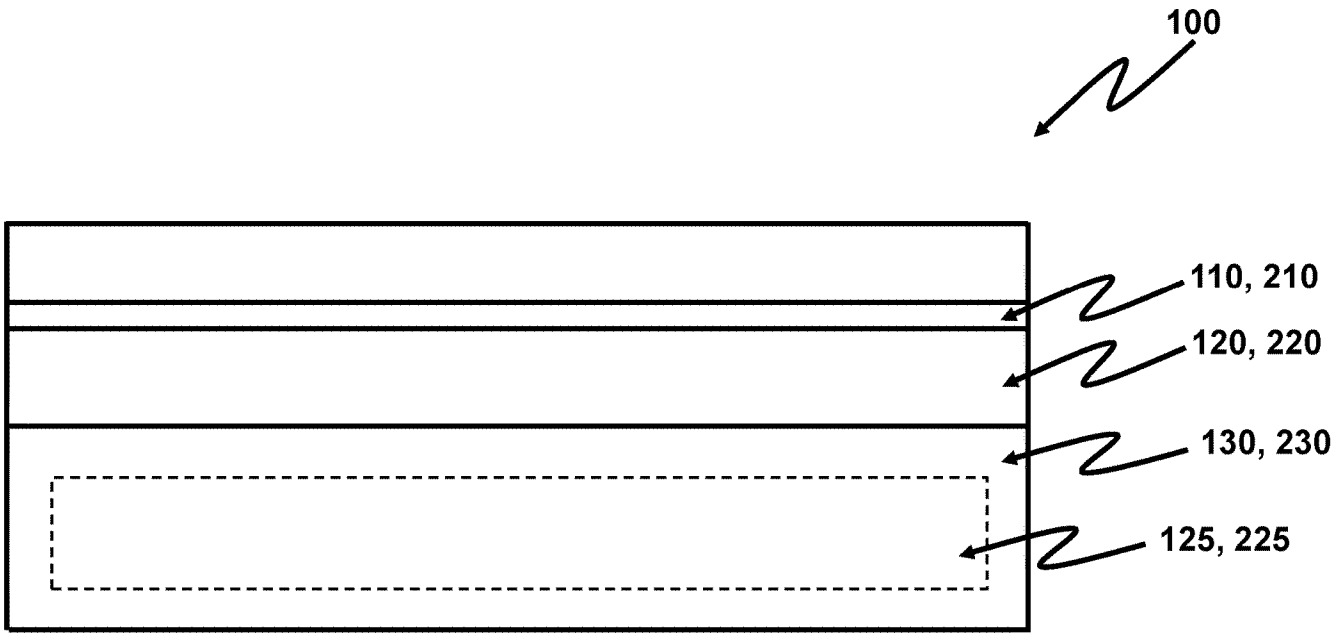
FIG. 2 is a front view illustrating the same embodiment of the present invention as seen in FIG. 1.

FIG. 2 is similar to FIG. 1 except that it shows a preferred embodiment of the present invention from a side view. Similarly labeled structures having the same reference numeral are the same in both drawings. In particular, it is noted that the device of the present invention bears reference numeral 100. It is also seen in FIG. 2 that protective covering strips 125 and 225 are employed to cover adhesive material 130 and 230. These materials are disposed in proposed positions, as seen in FIG. 1.

Figure 3:
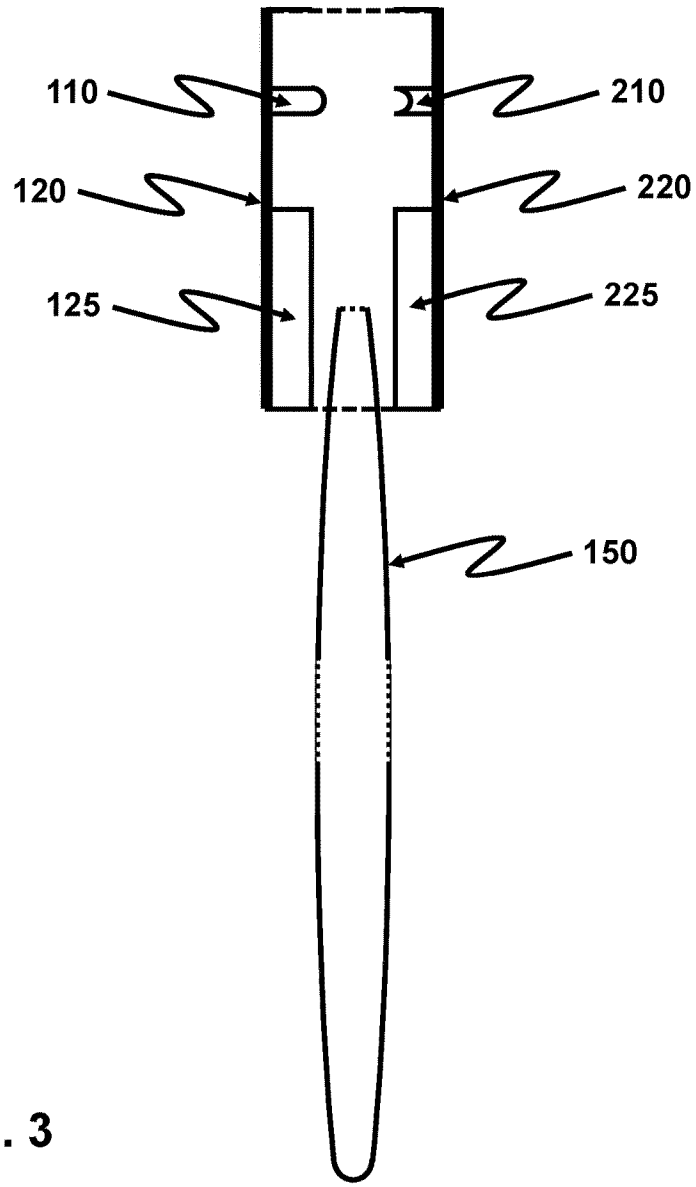
FIG. 3 a cross-sectional view illustrating the use of the present invention in performing a bag closure.

FIG. 3 illustrates the use of the present invention in closing bag 150. In particular, appealable protective material 125 and 225 is removed from the underlying adhesive layer one at a time. As each protective material strip is removed, it is placed flat against bag 150 and pressed to provide adhesion between the device and the bag. After the first protective material layer 120 or 225 is removed, the second protective layer is removed and one will find that the device of the present invention is naturally placed against the bag ready to have the second adhesive strip firmly pressed against the bag by the user. The width of the device of the present invention is naturally selected to be wider than the bag opening that it is designed to close. The adhesive material which is in contact with bag 150, when in place for closure, is also in contact with adhesive material on it supposed underlying strip/substrate 124 or 220.

Figure 4:
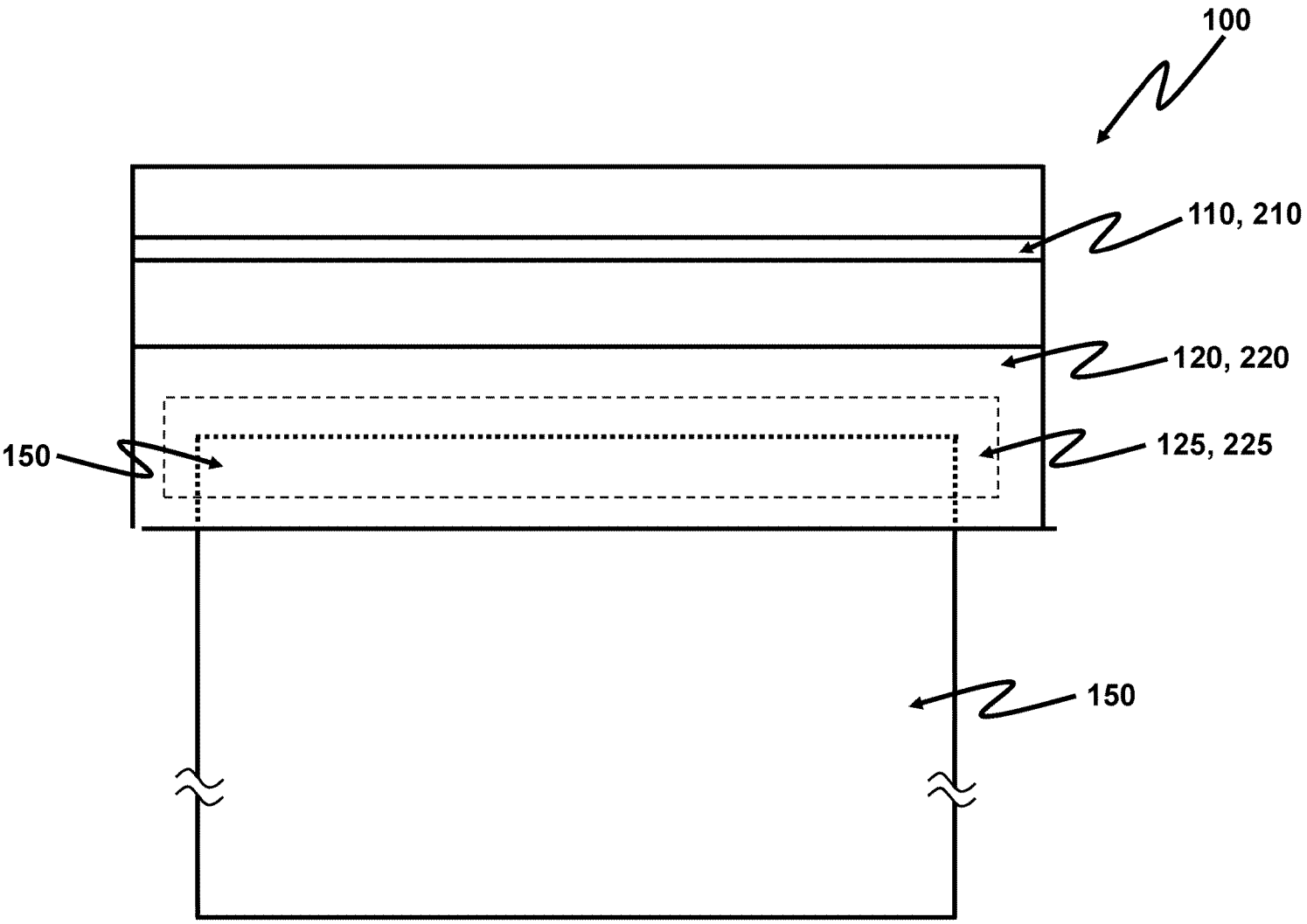
FIG. 4 is a front view illustrating the bag closure operation shown in FIG. 3.

FIG. 4 is a view similar to FIG. 3 except that the invention, in use with a bag which it closes, is seen in a side view. Portions of the invention that are not viewable are shown in dotted lines. This view is particularly relevant in that, as discussed above, it helps to relate the width of the invention with the width of the fact that it seeks to close. Naturally, the width of the invention is greater than the width of the bag opening.

Figure 5:
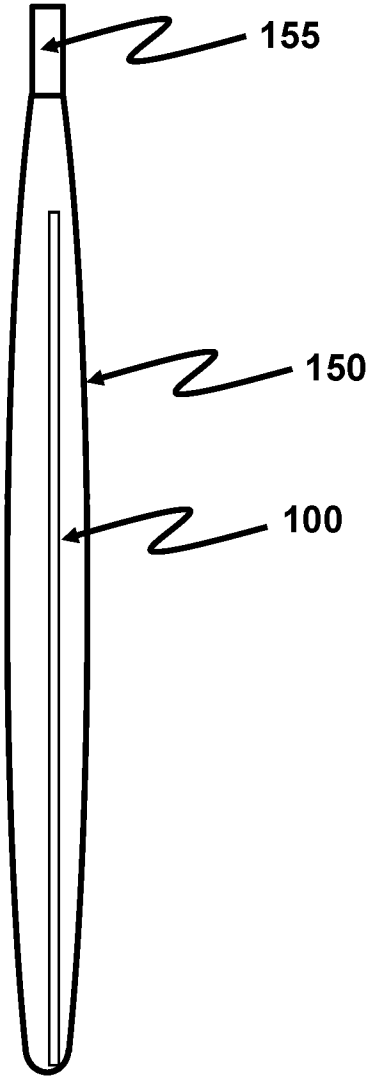
FIG. 5 is a cross-sectional side view illustrating the presence of the present invention within a food product container prior to its shipment.

The present invention is marketable in two different forms. In a first form, packets of the present invention are sold in groups of a plurality of closure devices. In this form, a user purchases a packet of devices and employs them as needed with various ones of the food products that they purchase. This is clearly a retrofit mode of operation where one is not at all concerned about the bag having its own closure mechanism. In a different form, the present invention is marketed in combination with a food product bag with which it is used. In this form, closure devices of the present invention are sold in combination with the food products and the food product bags that they are intended to close. This aspect of the present invention is illustrated in FIG. 5.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 USC § 112, sixth paragraph, unless the element is expressly recited using the phrase "means for."

While the invention has been described in detail herein in accordance with certain preferred embodiments thereof, many modifications and changes therein may be effected by those skilled in the art. Accordingly, it is intended by the appended claims to cover all such modifications and changes as fall within the spirit and scope of the invention.

What is claimed is:

1. An apparatus comprising:

a container having an openable end providing an opening to said container; and a sealing device for said container, said sealing device including a first portion and a second portion in which said first portion of said sealing device includes a length of press lock seal with opposing strip portions facing one another so as to form a closable seal; and in which said second portion of said sealing device is attached to said first portion of said sealing device, said second portion having strips of adhesive material disposed on opposed inside portions of said second portion of said sealing device, said adhesive material extending across said second portion and being sufficiently wide and affixed to said second portion of said device so that the end portion of said container immediately adjacent to its openable end is disposed above said adhesive material and so that the openable end of said container is also disposed below said adhesive material so that adhesive-to-adhesive contact is present above said openable end of said container as well as with adhesive-to-container contact below said openable end.

2. The apparatus of claim 1 in which said first portion includes a zipper.

3. The apparatus of claim 1 in which said first portion includes opposed, flexible mating structures that snap together to form a seal.

* * * * *